US006250951B1

(12) United States Patent
Milner et al.

(10) Patent No.: US 6,250,951 B1
(45) Date of Patent: Jun. 26, 2001

(54) WIRE SPACERS FOR CONNECTING CABLES TO CONNECTORS

(75) Inventors: John J. Milner, Milford; Joseph E. Dupuis, Ledyard; Alan C. Miller, Madison, all of CT (US); Karl E. Mortensen, Wakefield, RI (US)

(73) Assignee: Hubbell Incorporated, Orange, CT (US)

( * ) Notice: Subject to any disclaimer, the term of this patent is extended or adjusted under 35 U.S.C. 154(b) by 0 days.

(21) Appl. No.: 09/578,863

(22) Filed: May 26, 2000

Related U.S. Application Data

(62) Division of application No. 09/296,659, filed on Apr. 23, 1999, now Pat. No. 6,099,345.

(51) Int. Cl.[7] ..... H01R 13/58

(52) U.S. Cl. ..... 439/460; 439/418; 439/934; 439/344; 174/27

(58) Field of Search ..... 439/460, 344, 439/676, 418, 941, 934; 174/32, 34, 27, 138 E, 146

(56) References Cited

U.S. PATENT DOCUMENTS

| | | | | |
|---|---|---|---|---|
| 251,552 | | 12/1881 | Edison . | |
| 483,285 | | 9/1892 | Guilleaume | 174/27 |
| 680,150 | | 8/1901 | Hultman . | |
| 736,351 | | 8/1903 | Bennet et al. . | |
| 1,089,642 | | 3/1914 | Honold . | |
| 1,856,109 | | 5/1932 | Murray . | |
| 2,204,737 | | 6/1940 | Swallow et al. . | |
| 2,595,857 | | 6/1952 | Kinsel . | |
| 2,887,524 | | 5/1959 | Fulps . | |
| 3,336,436 | | 8/1967 | Markham . | |
| 4,601,530 | | 7/1986 | Coldren et al. | 439/460 |
| 5,665,936 | | 9/1997 | Sawamura et al. | 174/32 |
| 5,673,009 | | 9/1997 | Klas et al. | 439/607 |
| 5,824,957 | | 10/1998 | Holshausen | 174/95 |
| 6,056,586 | * | 5/2000 | Lin | 439/460 |
| 6,109,954 | * | 8/2000 | Lin | 439/460 |

* cited by examiner

*Primary Examiner*—Tho D. Ta
(74) *Attorney, Agent, or Firm*—Mark S. Bicks

(57) ABSTRACT

An electrical connector has a connector body with a cable cavity at its cable connection end and a strain relief coupled to the connector body adjacent the cable connection end. The strain relief extends into the cable cavity. A wire spacer is mounted in the cable cavity adjacent to strain relief. This spacer has a central core and four radially outwardly projecting flanges. The flanges are angular spaced from one another by angles of substantially 90 degrees. The spacer maintains separation of twisted wired pairs in a cable which is secured to the connector by the strain relief to enhance the electrical performance of the connector.

16 Claims, 5 Drawing Sheets

WIRE SPACERS FOR CONNECTING CABLES TO CONNECTORS

REFERENCE TO RELATED APPLICATION

This application is a divisional application of application Ser. No. 09/296,659, filed Apr. 23, 1999, now U.S. Pat. No. 6,099,345.

FIELD OF THE INVENTION

The present invention relates to a wire spacer for placement in a cable having four twisted wire pairs enclosed in a flexible insulating sheath to prevent the wire pairs from becoming intertwined when the sheath with the twisted wire pairs therein or the twisted wire pairs without the sheath are radially compressed by a connector strain relief. More particularly, the present invention relates to an electrical connector and a cable having the wire spacer, and to certain forms of the wire spacer.

BACKGROUND OF THE INVENTION

Due to advancements made in telecommunications and data transmissions speeds over unshielded twisted wire pair cables, the connectors (such as jacks and plugs) have become critical impediments to high performance data transmission at high frequencies. Some performance characteristics, particularly due to near end crosstalk, degrade beyond acceptable levels at the higher frequencies, particularly for category 5 and category 6 environments.

When electrical signals are carried on a signal line or wire which is in close proximity to another signal line or other signal lines, energy from one signal can be coupled onto adjacent signal lines by means of the electric field generated by the potential between the two signal lines and the magnetic field generated as a result of the changing electric fields. This coupling, whether capacitive or inductive is called crosstalk, when the coupling occurs between two or more signal lines.

Crosstalk is a noise signal and degrades the signal-to-noise margin (s/n) of a system. In communications systems, reduced s/n margin results in greater error rates in the information conveyed on the signal lines.

One way to overcome this crosstalk problem is to increase the spacing between the signal lines. Another method that can be used is to shield the individual signal lines. However, in many cases, the wiring is pre-existing and standards define geometries and pin definitions for connectors making the necessary changes to such systems cost prohibitive. In this specific situation of communications systems, using unshielded twisted pair wiring cables is the only practical alternative.

Performance requirements for conductive pathways are set forth in ANSI/TIA/EIA-568-A, (commercial building telecommunications cabling standard). In category 6 draft-addendum in that standard, the minimum acceptable performance values are 54 dB at 100 MHz, 48 dB at 200 MHz and 46 dB at 250 MHz.

Crosstalk generated at the connection between cables and the connectors, particularly plug connectors has become a significant problem. A very significant problem involves the deformation of the cable by the connector strain relief.

SUMMARY OF THE INVENTION

An object of the present invention is to provide an electrical connector for communications systems, a wire spacer for an electrical connector or a cable for connection to a communications systems electrical connector which will reduce or not induce crosstalk in the system.

Another object of the present invention is to provide an electrical connector, wire spacer, or cable with reduced crosstalk, but without providing shielding and without changing the standardized form of the connector or the cable.

A further object of the present invention is to provide an electrical connector, wire spacer and cable with reduced crosstalk which is simple and inexpensive to manufacture and to install.

Yet another object of the present invention is to provide an electrical connector for communications systems, a wire spacer for an electrical connector or a cable for connection to a communications systems electrical connector with greater mechanical strain relief by increasing the interference between the cable and the connector strain relief for resisting axial forces at the cable-strain relief interface.

The foregoing objects are basically obtained by an electrical connector comprising a connector body, a cable strain relief and a wire spacer. The connector body has a cable cavity at a cable connection end of the connector body. The strain relief is coupled to the connector body adjacent the cable connection end, and extends into the cable cavity. The wire spacer is mounted in the cable cavity adjacent the strain relief, and has a central core and four radially outwardly projecting flanges. The flanges are angularly spaced from one another by angles of substantial 90 degrees.

The foregoing objects also obtained by a wire spacer for separating twisted wire pairs of cable extending into an electrical connector strain relief. The wire spacer has a central core extending along a longitudinal axis and four flanges extending radially relative to the longitudinal axis from the central core. The flanges are angularly spaced from one another by angles of substantially 90 degrees. Each of the flanges tapers in a direction from its free end towards the central core.

The foregoing objects are additionally obtained by an electrical cable for electrical communications systems comprising four twisted pairs extending along a longitudinal axis, a flexible inflating sheath surrounding at least a longitudinal portion of the four twisted wire pairs, and a wire spacer extending axially relative to the sheath. The twisted pairs extend from at least one longitudinal end of the sheath. The wire spacer is adjacent one sheath longitudinal end. The spacer is significantly shorter than the sheath along the longitudinal axis, and includes an axially extending central core and four angular spaced flanges extending radially outwardly from the central core to define four separate chambers. Each of the chambers receives one of the twisted wire pairs to maintain separation between the pairs even when the twisted wire pairs are radially compressed.

By forming the connector, wire spacer and cable in this manner, the flanges of the wire spacer maintain the separation between the four pairs of twisted wires even when the cable is radially compressed by the strain relief of a connector. Without the wire spacer, the twisted wire pairs would be intertwined at the strain relief causing substantial crosstalk between the various wires at this point. The increased crosstalk would degrade system performance beyond acceptable levels, particularly for category 6 installations.

Other objects, advantages and salient features of the present invention will become apparent from the following detailed description, which, taken in conjunction with the annexed drawings, discloses preferred embodiments of the present invention.

BRIEF DESCRIPTION OF THE DRAWINGS

Referring to the drawings which form a part of this disclosure.

DETAILED DESCRIPTION OF THE INVENTION

Figure 1:
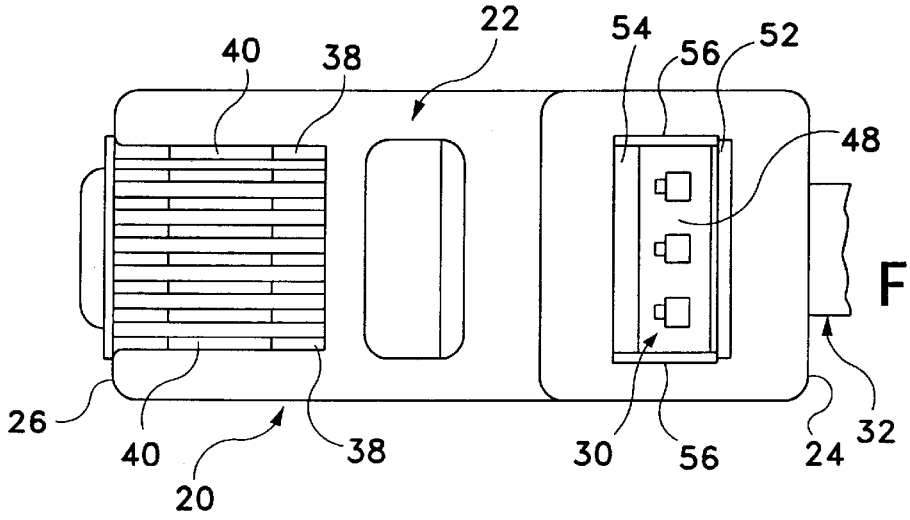
FIG. 1 is a top plan view of an electrical connector with a cable connected thereto according to the present invention.
Figure 2:
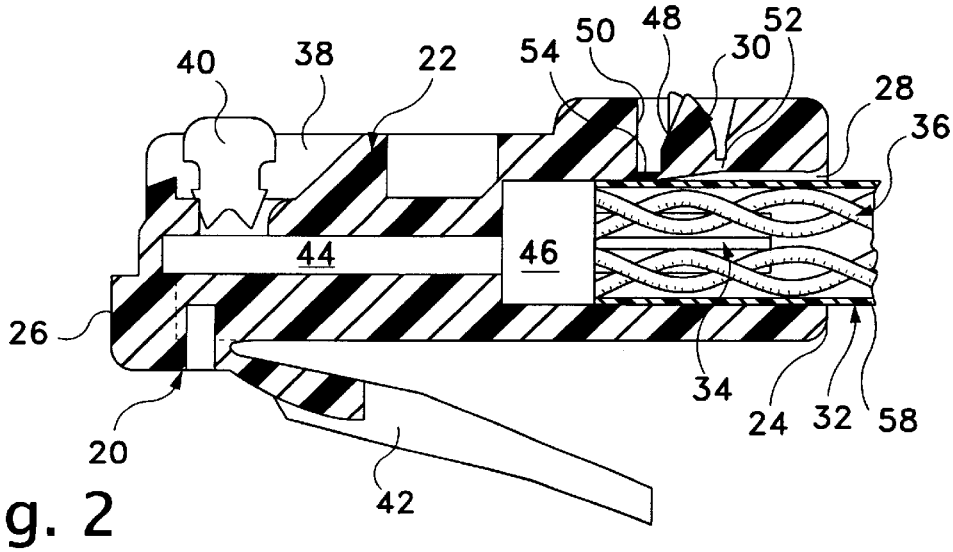
FIG. 2 is a side elevational view in section of the electrical connector and cable of FIG. 1, with the strain relief in its initial or disengaged position.
Figure 3:
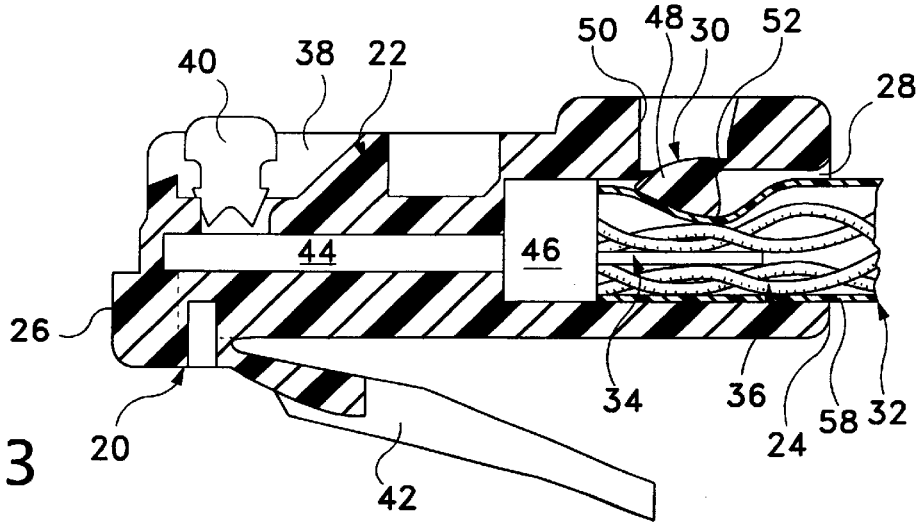
FIG. 3 is a side elevational view in section of the electrical connector and cable of FIG. 2 with the strain relief moved to its engaged position restraining withdrawal of the cable.

Referring initially to FIGS. 1–3, an electrical connector 20 according to the present invention comprises a connector body 22 having a cable connection end 24 and a contact end 26 at the opposite longitudinal ends of the connector body. A cable cavity 28 is provided in the connector body at the cable connection end. A strain relief 30 is coupled to connector body 20 adjacent cable connection end 24 for engaging cable 32 received in the cable cavity 28. A wire spacer 34 is mounted in cable cavity 28 adjacent strain relief 30 for maintaining separation of the four twisted wire pairs 36 of cable 32 when strain relief 30 radially compresses the cable.

Connector body 22 is generally constructed as disclosed in copending U.S. patent application Ser. No. 09/201,141, filed on Nov. 30, 1998 in the names of Joseph Dupuis, John J. Milner, Richard A. Fazio and Robert A. Aekins and Karl Mortensen and entitled Communication Connector With Wire Holding Sled, now U.S. Pat. No. 6,080,007 the subject matter which is hereby incorporated by reference. Connector body or plug housing 22 has a plurality of walls which define cable cavity 28. The cable cavity opens on cable connection end 24 and extends longitudinally through most of the connector body. Slots 38 extend through an upper housing wall adjacent front or contact end 26 and into cable cavity 28. Each slot receives an insulation displacement contact 40.

These contacts can be moved from the elevated position illustrated in FIGS. 2 and 3 to a compressed position. In the compressed position, the upper portion of each contact is within the slot 38 and the lower portion of each contact displaces the insulation about one of the individual wires 36 to become mechanically engaged and electrically connected to the individual conductor within the respective wire 36. The outer configuration of the connector body, including releasable latch 42 and the positions of contacts 40 in slots 38, conforms to standard connector geometry and pin out definitions for communications systems.

Forward or toward contact end 26 of strain relief 30, cable cavity 28 houses a front sled 44 and a rear sled 46. The front sled orients the eight wires from the cable in position for coupling to the eight insulation displacement contacts. The rear sled orients the eight wires for crosstalk reduction, return loss improvement and constant electrical characteristics. After the wiring is positioned within the two sleds, the two sleds are slid into connector body 22 for assembly of the plug connector and termination of the wires by movement of the contacts into mechanical and electrical connection with the conductors in wires 36. Since the configurations of the sleds and their assembly with the wires is fully disclosed in the prior application incorporated by reference, no further description thereof is provided.

Strain relief 30 comprises an engagement member 38 located within a recess 50 of connector body 22. The engagement member is formed as a unitary part of the connector body and is connected to the remainder of the connector body by a hinge portion 52 and a frangible portion 54. Hinge portion 52 is on the rear side of engagement member 48, while frangible portion 54 is on the forward side of the engagement member. Slits 56 are provided on the opposite lateral sides of the engagement member to provide a separation at such sides from the adjacent portion of the connector body.

When the cables are first installed, as illustrated in FIG. 2, engagement member 38 is located within recess 50 and spaced from or outside of cable cavity 28. Frangible portion 54 is intact and generally coplanar with hinge portion 52. After the cable is fully inserted, crimping forces are applied to the engagement member causing it to pivot downwardly about hinge portion 52 as frangible portion 54 fractures. The force is applied until the engagement member reaches the position illustrated in FIG. 3. A deformation of the hinge portion and of the part of the frangible portion remaining connected to the connector body adjacent the recess allows the free end of the engagement member to pivot past the lower end of the recess and then engage a portion of the body adjacent the lower end of the recess to maintain the engagement member in its engaged position. In this engaged position, the cable is securely engaged with the connector to provide strain relief for the connection of the individual conductors to contacts 40. Strain relief 30 can apply a compressive forces in one or more radial directions.

As standard in the communications field, cable 32 comprises four twisted wired pairs. Each wire comprises a conductor surrounded by insulation, but is not provided with any shielding. The four twisted wired pairs are surrounded by a flexible insulating sheath 58.

According to conventional practice, the conductors of each twisted wire pair are coupled to signal sources which are equal and opposite (i.e., differently driven to each other). The twisting of the wires cancels the electrical and magnetic fields produced by the signals conducted through the conductors of the wires of each twisted pair.

Figure 13:
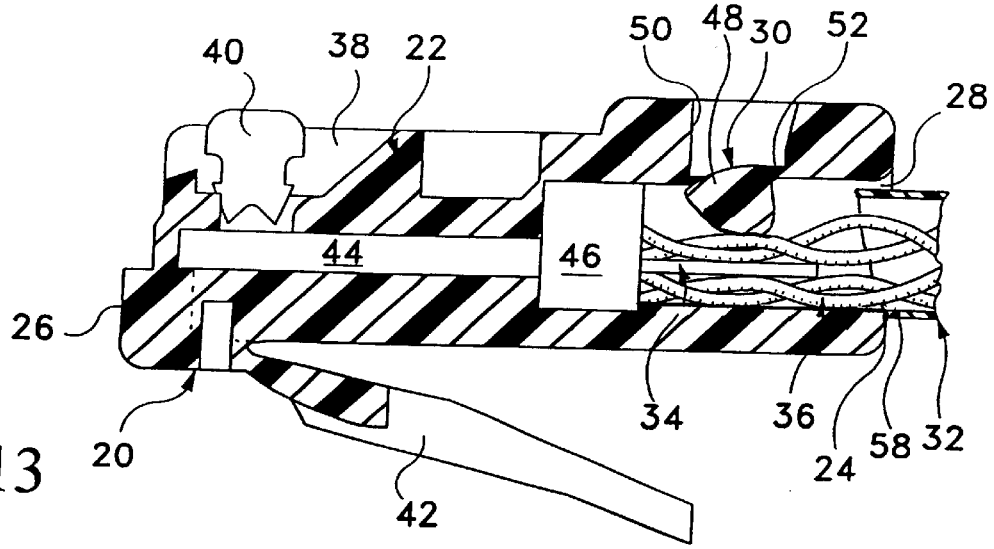
FIG. 13 is a side elevational view in section of an electrical cable and connector according to an alternative embodiment of the present invention with the strain relief in its engaged position and the wire spacer extending outside the cable sheath.

As long as the wires of the respective pairs are not intermingled adequate electrical performance is obtained. Since the pairs would tend to become intertwined or meshed together at the strain relief due to the radial force applied by the strain relief on the sheath outer surface, wire spacer 34 is placed within the cable between the various wire pairs to maintain the separation of the twisted wire pairs, without interfering with the performance of the strain relief. Alternatively, the wire spacer can be located outside of the sheath and adjacent the strain relief when the cable sheath does not extend into the cable cavity to the strain relief, as illustrated in FIG. 13. In this alternative arrangement, the wire spacer extends between the twisted wire pairs, with at least one of the twisted wire pairs being directly engaged by the strain relief.

Figure 4:
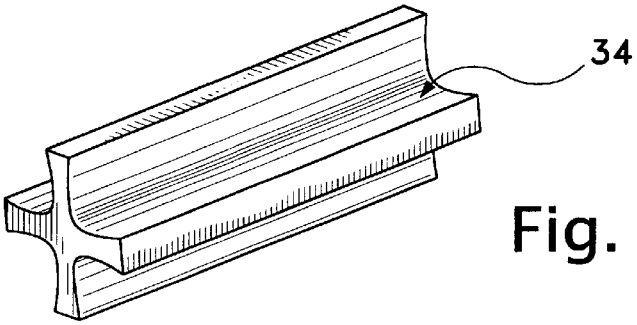
FIG. 4 is a perspective view of a wire spacer according to a first embodiment of the present invention.
Figure 5:
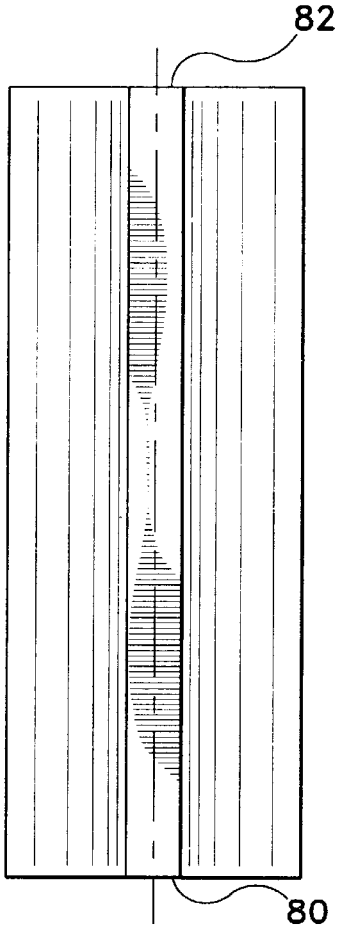
FIG. 5 is a top plan view of the wire spacer of FIG. 4.
Figure 6:
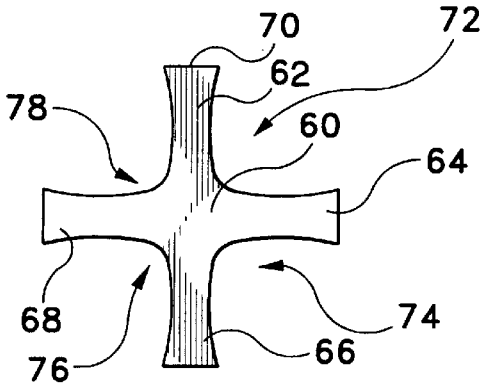
FIG. 6 is an end elevational view of the wire spacer of FIG. 4.

The first embodiment of wire spacer 34 is illustrated in FIGS. 4–6. Wire spacer 34 comprises a central core 60 and four radially outwardly projecting flanges or fins 62, 64, 66 and 68. The four flanges are angular spaced from one another by angles of substantially 90 degrees. In this manner, flanges 62 and 66 are essentially coplanar; and flanges 64 and 68 are substantially coplanar and perpendicular to flanges 62 and 66. Adjacent flanges are connected adjacent the center core by a curved concave surface. The spacer is made of an insulating material. Preferably, that material is plastic.

Each of the flanges is tapered in a direction from a free end 70 toward central core 62. In this manner, the flanges are somewhat wider at their free ends than at the locations between the free ends and the central core. By such tapering of the flanges, the four separate chambers 72, 74, 76 and 78 defined between adjacent pairs of the flanges are each somewhat undercut. The undercutting assists in retaining a respective twisted wire pair in each chamber.

The longitudinal ends 80 and 82 of spacer 34 are substantially planar. Between the longitudinal ends, the wire spacer has a uniform transverse cross section along its entire length. The central core is solid throughout its length.

The wire spacer can be inserted and extends into the cable such that the core extends between the four twisted wire pairs and the flanges separate the four twisted wire pairs. The wire spacer extends axially or longitudinally for only portion of the length of the sheath and is adjacent to a cut or longitudinal end of the sheath. The length of the wire spacer is significantly shorter than that of the sheath, along their longitudinal axes. Since the end of sheath 58 is adjacent strain relief 30, the wire spacer is also adjacent the strain relief. The flanges extend radially outwardly from the core to at least near the sheath such that the chambers are defined at their outer peripheries by sheath 58. Alternatively, the sheath can terminate adjacent cable connection end 24 such that strain relief engagement member 48 directly engages at least one of the twisted wire pairs and the wire spacer is located adjacent, but outside the cable sheath longitudinal end.

Figure 7:
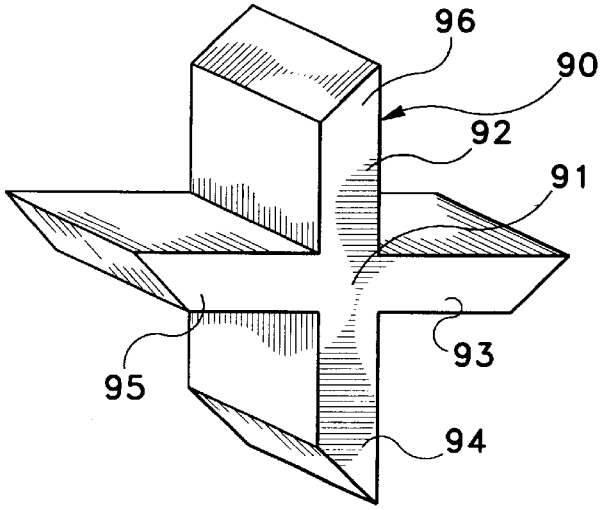
FIG. 7 is a perspective view of a wire spacer according to a second embodiment of the present invention.

A wire spacer 90 according to a second embodiment of the present invention is illustrated in FIG. 7. This spacer has a uniform transverse cross section along its entire length defined by a central core 91 and four orthogonally oriented fins or flanges 92, 93, 94 and 95. Each of the flanges has a tapered portion 96 adjacent a free end thereof. Portions 96 start at a distance radially spaced from the core, and taper in a direction away from core 91 and toward the free end of the respective flange. Relatively sharp corners are provided between the adjacent flanges, rather than rounded corners as in the first embodiment.

Figure 8:
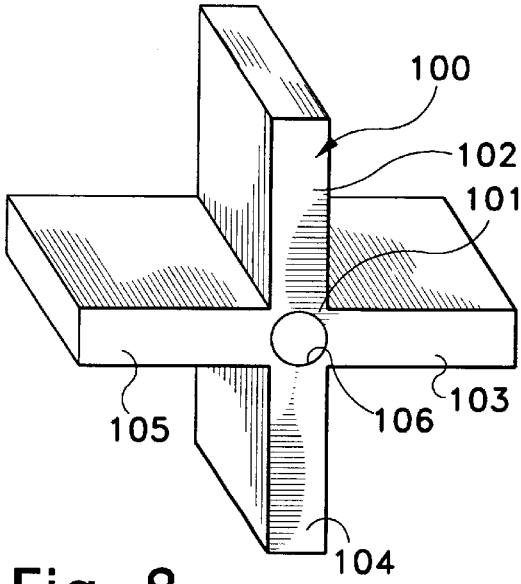
FIG. 8 is a perspective view of a wire spacer according to a third embodiment of the present invention.

A wire spacer 100 according to a third embodiment of the present invention is illustrated in FIG. 8. Wire spacer 100 comprises a central core 101 and four flanges 102, 103, 104 and 105. The flanges meet at relatively sharp corners. Each of the flanges is generally in the form of a rectangular parallelepiped. The core is provided with a central and axially extending bore 106 such at the central core is hollow. Making the core hollow facilitates displacement of the spacer during the actuation of the strain relief to provide a crimping action. Each of the flanges has opposed planar surfaces and flat planar free ends extending perpendicular to the opposed planar surfaces.

Figure 9:
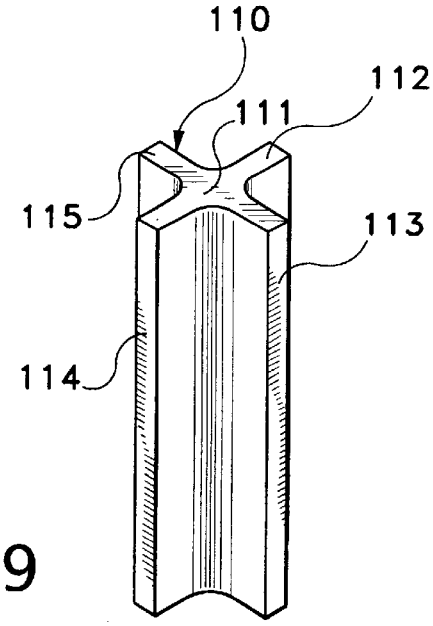
FIG. 9 is a perspective view of a wire spacer according to a fourth embodiment of the present invention.

A wire spacer 110 according to a fourth embodiment of the present invention is illustrated in FIG. 9. Spacer 110 has a solid central core 111 and four flanges 112, 113, 114 and 115 angularly spaced by angles of approximately 90 degrees. Wire spacer 110 is similar to wire spacer 34, except wire spacer 110 has flanges with planar opposite surfaces which do not taper toward the central core as in wire spacer 34.

Figure 10:
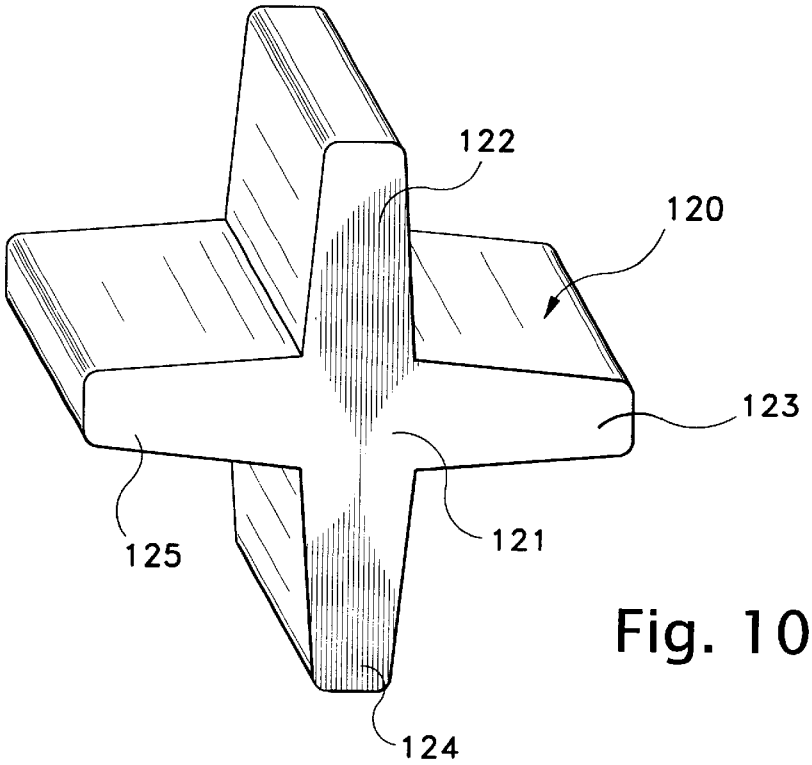
FIG. 10 is a perspective view of a wire spacer according to a fifth embodiment of the present invention.

A wire spacer 120 according to a fifth embodiment of the present invention is illustrated in FIG. 10. Wire spacer 120 comprises a central core 121 and flanges 122, 123, 124 and 125. Flanges are angularly spaced by approximately 90 degree angles. Both the core and the flanges are of uniform or constant transverse cross section through the entire length of the wire spacer. Each of the flanges taper in a radial direction outward from the core toward the free end 126 of the respective flange. Free ends 126 are provided with rounded edges. Although the wire spacer is shown with four flanges, a different number, either larger or smaller, can be provided.

Figure 11:
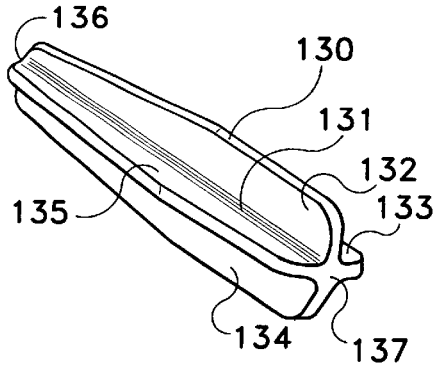
FIG. 11 is a perspective view of a wire spacer according to a sixth embodiment of the present invention.

A wire spacer 130 according to a sixth embodiment of the present invention is illustrated in the FIG. 11. Spacer 130 comprises a central core 131 and angularly oriented flanges 132, 133, 134 and 135. The axial ends 136 and 137 are rounded. Additionally, the free edges of the four flanges are rounded. The axial or longitudinal half of each flange is tapered from approximately its longitudinal midpoint toward end 136. This tapering facilitates insertion of the wire spacer into the cable between the twisted wire pairs. Although both ends are illustrated as being rounded, the spacer can be made with only one rounded end.

Figure 12:
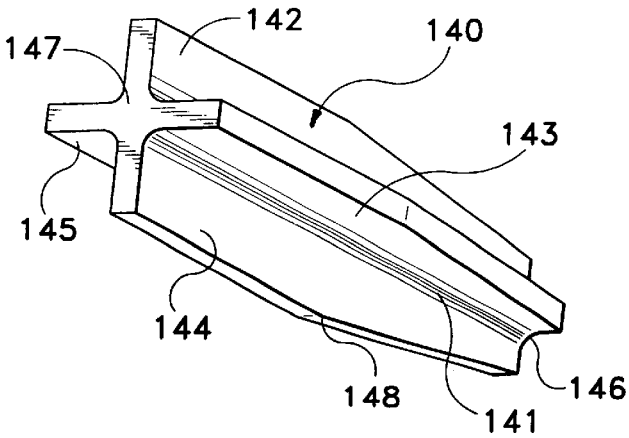
FIG. 12 is a perspective view of a wire spacer according to a seventh embodiment of the present invention.

A wire spacer 140 according to seventh embodiment of the present invention is illustrated in FIG. 12. Wire spacer 140 comprises a central core 141 and flanges 142, 143, 144 and 145. The adjacent flanges are substantially perpendicularly oriented. The ends 146 and 147 of the spacer are planar. A radius can be provided between the inner ends of the adjacent flanges at the core. From a midpoint 148 along the longitudinal length of each flange, the radial height of each flange decreases such that the flanges taper from midpoint 148 in a direction toward end 146.

While various embodiments have been chosen to illustrated the invention, it will be understood by those skilled in the art that various changes and modifications can be made therein without departing from the scope of the invention as defined in the appended claims.

What is claimed is:

1. A wire spacer for separating twisted wire pairs of a cable extending into an electrical connector strain relief, comprising:

a central core extending along a longitudinal axis; and four flanges extending radially outwardly relative to said longitudinal axis from said central core and being angularly spaced from one another by angles of substantial ninety degrees, each of said flanges tapering in a direction from a free radial end thereof towards said central core, said central core and said flanges having free longitudinal ends.

2. A wire spacer according to claim 1 wherein said longitudinal free ends are not fixedly connected to an electrical connector.

3. A wire spacer according to claim 1 wherein each of said longitudinal free ends is defined by an exposed, planar surface.

4. An electrical cable for electrical communications systems; comprising:

four twisted wire pairs extending along a longitudinal axis;

a flexible, insulating sheath surrounding at least a longitudinal portion of said four twisted wire pairs, said twisted wire pairs extending from at least one longitudinal end of said sheath; and a wire spacer extending axially relative said sheath and adjacent said one longitudinal end thereof, said wire spacer being significantly shorter than said sheath along said longitudinal axis and including an axially extending central core and four angularly spaced flanges extending radially outwardly from said central core defining four separate chambers, each of said chambers receiving one of said twisted wire pairs to maintain separation therebetween even when said twisted wire pairs are radially compressed, said core and each of said flanges having opposite first and second free longitudinal ends not fixedly attached to an electrical connector.

5. An electrical cable according to claim 4 wherein said flanges extend radially outwardly from said central core to at least near said sheath.

6. An electrical cable according to claim 4 wherein said wire spacer extends outside said sheath adjacent one longitudinal end thereof.

7. An electrical cable according to claim 4 wherein each of said free ends is defined by an exposed, planar surface.

8. An electrical connector, comprising:

a connector body having a cable cavity at a cable connection end of said connector body;

a cable strain relief coupled to said connector body adjacent said cable connection end and extending into said cable cavity; and a wire spacer, received in said cable cavity adjacent said strain relief and relatively movable relative to said connector body, said wire spacer having a central core and four radially outwardly projecting flanges, said flanges being angularly spaced from one another by angles of substantially ninety degrees.

9. An electrical connector according to claim 8 wherein said strain relief comprises an engagement member movable in only one radial between a receiving position and an engaged position extending into said cable cavity.

10. An electrical connector according to claim 9 wherein said engagement member is coupled to said connector body by a hinge portion and a frangible portion at opposite parts thereof.

11. An electrical connector according to claim 8 wherein a cable having four twisted wire pairs extends into said cable cavity and is engaged by said strain relief; and said wire spacer extends into said cable with said core extending between said four twisted wire pairs and with said flanges separating said four twisted wire pairs.

12. An electrical connector according to claim 11 wherein said cable comprises an insulating sheath surrounding said four twisted wire pairs and said wire spacers, extending into said cable cavity, and being directly engaged by said strain relief.

13. An electrical connector according to claim 11 wherein said connector body has electrical contacts mounted therein adjacent a connector end thereof opposite said cable connection end; and said contacts are adapted to engage and be electrically connected to conductors in said twisted wire pairs.

14. An electrical connector according to claim 11 wherein said strain relief comprises an engagement member movable in only one radial direction between a receiving position and an engaged position extending into said cable cavity and gripping said cable between said engagement member and a wall of said connector body defining said cable cavity.

15. An electrical connector according to claim 8 wherein said cable cavity extends along a longitudinal axis into said connector body;

said strain relief extends radially relative to said longitudinal axis into said cable cavity; and said wire spacer is movable radially in said cable cavity relative to said longitudinal axis.

16. An electrical connector according to claim 15 wherein a cable having four twisted wire pairs extends into said cable cavity and is engaged by said strain relief, and said wire spacer extends into said cable with said core extending between said four twisted wire pairs and with said flanges separating said four twisted wire pairs.

* * * * *